US011701762B2

(12) United States Patent
Shi et al.

(10) Patent No.: US 11,701,762 B2
(45) Date of Patent: Jul. 18, 2023

(54) TORQUE WRENCH WITH IMPROVED TORQUE SETTING ADJUSTMENT

(71) Applicant: Apex Brands, Inc., Apex, NC (US)

(72) Inventors: Minglin Shi, Shanghai (CN); Chenglai Zhang, Shanghai (CN)

(73) Assignee: Apex Brands, Inc., Apex, NC (US)

( * ) Notice: Subject to any disclaimer, the term of this patent is extended or adjusted under 35 U.S.C. 154(b) by 0 days.

(21) Appl. No.: 18/017,513

(22) PCT Filed: Aug. 4, 2020

(86) PCT No.: PCT/CN2020/106770

§ 371 (c)(1),
(2) Date: Jan. 23, 2023

(87) PCT Pub. No.: WO2022/027219

PCT Pub. Date: Feb. 10, 2022

(65) Prior Publication Data

US 2023/0191569 A1 Jun. 22, 2023

(51) Int. Cl.
*B25B 23/142* (2006.01)
*B25B 13/46* (2006.01)

(52) U.S. Cl.
CPC ..... *B25B 23/1425* (2013.01); *B25B 23/1427* (2013.01); *B25B 13/463* (2013.01)

(58) Field of Classification Search
CPC ..... B25B 23/1422; B25B 23/1425; B25B 13/463
See application file for complete search history.

(56) References Cited

U.S. PATENT DOCUMENTS 4,125,016 A * 11/1978 Lehoczky ..... B25B 23/1425 73/862.338
8,714,057 B2 * 5/2014 Anjanappa ..... B25B 23/1425 81/479
8,844,381 B2 * 9/2014 Gharib ..... B25B 23/1425 81/479
9,085,072 B2 * 7/2015 Anjanappa ..... B25B 23/1427
9,156,148 B2 * 10/2015 King ..... B25B 23/1425
9,308,633 B2 * 4/2016 Gharib ..... B25B 23/1425
(Continued)

FOREIGN PATENT DOCUMENTS

CN 104552120 A 4/2015
CN 206677858 U 11/2017
(Continued)

OTHER PUBLICATIONS

International Search Report Written Opinion of International Application No. PCT/CN2020/106770 dated Apr. 27, 2021, all pages cited in its entirety.

*Primary Examiner* — David B. Thomas
(74) *Attorney, Agent, or Firm* — Burr & Forman LLP

(57) ABSTRACT

A torque wrench (100, 400) may include a body (410), a force detector (420) operably coupled to the body and configured to detect a bending force applied to the body, and a user interface (140) operably coupled to the body and the force detector. The user interface may be configured to include a setting mode in which a variable feature of the torque wrench is adjustable. The user interface may be further configured to, when in the setting mode, adjust the variable feature based on the bending force applied to the body and detected by the force detector.

20 Claims, 3 Drawing Sheets

(56) References Cited

U.S. PATENT DOCUMENTS

| | | | | |
|---|---|---|---|---|
| 9,839,997 | B2 * | 12/2017 | King | B25B 23/1425 |
| 10,112,288 | B2 * | 10/2018 | King | B25B 23/1422 |
| 11,400,569 | B2 * | 8/2022 | Hsieh | B25B 23/1425 |
| 11,565,388 | B2 * | 1/2023 | Hsieh | B25B 23/1425 |
| 2020/0164496 | A1 * | 5/2020 | Hsieh | B25B 23/1425 |
| 2020/0171631 | A1 | 6/2020 | Hu | |
| 2021/0260737 | A1 * | 8/2021 | Hsieh | B25B 23/1425 |

FOREIGN PATENT DOCUMENTS

| | | | |
|---|---|---|---|
| CN | 207147682 | U | 3/2018 |
| JP | 2008296355 | A | 12/2008 |
| JP | 2020512201 | A | 4/2020 |

* cited by examiner

FIG. 1.
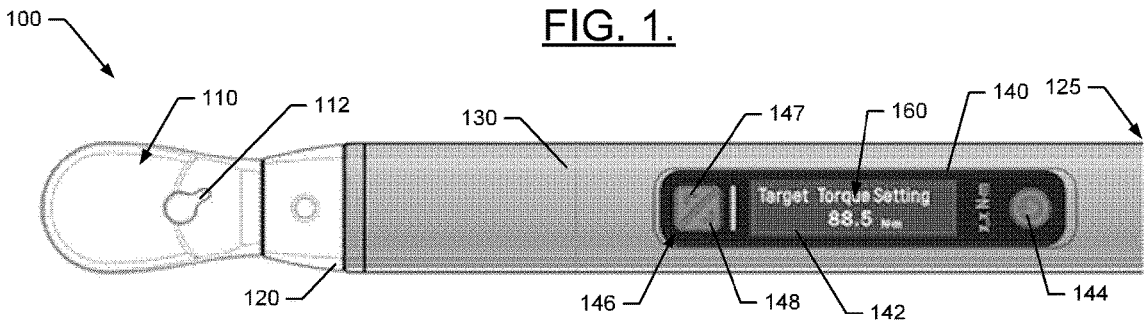
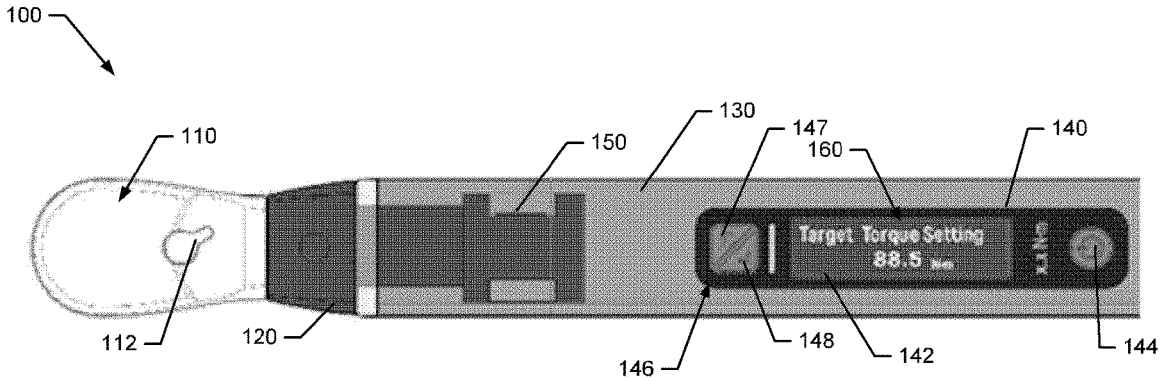
FIG. 2.

TORQUE WRENCH WITH IMPROVED TORQUE SETTING ADJUSTMENT

TECHNICAL FIELD

Example embodiments generally relate to hand tools and, in particular, relate to a torque wrench with an improved torque adjuster.

BACKGROUND

Hand tools are commonly used across all aspects of industry and in the homes and workshops of consumers. Hand tools are employed for multiple applications including, for example, fastener tightening, component joining, and/or the like. For some fastener tightening applications, a highly accurate torque setting is either preferred or required. To provide the ability to accurately apply torque, a class of hand tools referred to generally as torque wrenches have been developed. Torque wrenches are calibrated devices that enable the operator to know when a particular torque is reached. The means by which the operator is informed of the fact that the particular torque has been reached and the means by which the operator selects torque settings for torque wrenches that are adjustable can vary with corresponding different types of torque wrenches.

For one particular type of torque wrench, a display screen may be provided to display the torque setting, and the user may utilize one or more buttons to adjust the torque setting either up or down. Unfortunately, users report difficulty in achieving smooth operation of such devices based on concerns that the buttons break, get worn out, or otherwise do not function optimally. Even for other types of adjusters, user feedback demonstrates that the ability to interface with the adjuster can be poor. Accordingly, it may be desirable to improve the way by which an adjustment to the torque setting is made for an adjustable torque wrench.

BRIEF SUMMARY OF SOME EXAMPLES

Some example embodiments may enable the provision of an improved interface for the adjuster of an adjustable torque wrench.

In an example embodiment, a torque wrench may be provided. The torque wrench may include a body, a force detector operably coupled to the body and configured to detect a bending force applied to the body, and a user interface operably coupled to the body and the force detector. The user interface may be configured to include a setting mode in which a variable feature of the torque wrench is adjustable. The user interface may be further configured to, when in the setting mode, adjust the variable feature based on the bending force applied to the body and detected by the force detector.

In another example embodiment, a torque adjuster configured to enable a torque setting of a torque wrench is provided. The torque adjuster may include a force detector operably coupled to a body of the torque wrench and configured to detect a bending force applied to the body. The torque adjuster may further include a user interface operably coupled to the body and the force detector. The torque setting may be variably adjustable via the user interface based on the bending force applied to the body and detected by the force detector.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 1 illustrates a top view of a torque wrench according to an example embodiment;

FIG. 2 illustrates a different top view of the torque wrench of FIG. 1 in that some part of the handle of the torque wrench is transparent in order to expose some internal components to viewing according to an example embodiment;

Figure 3A:
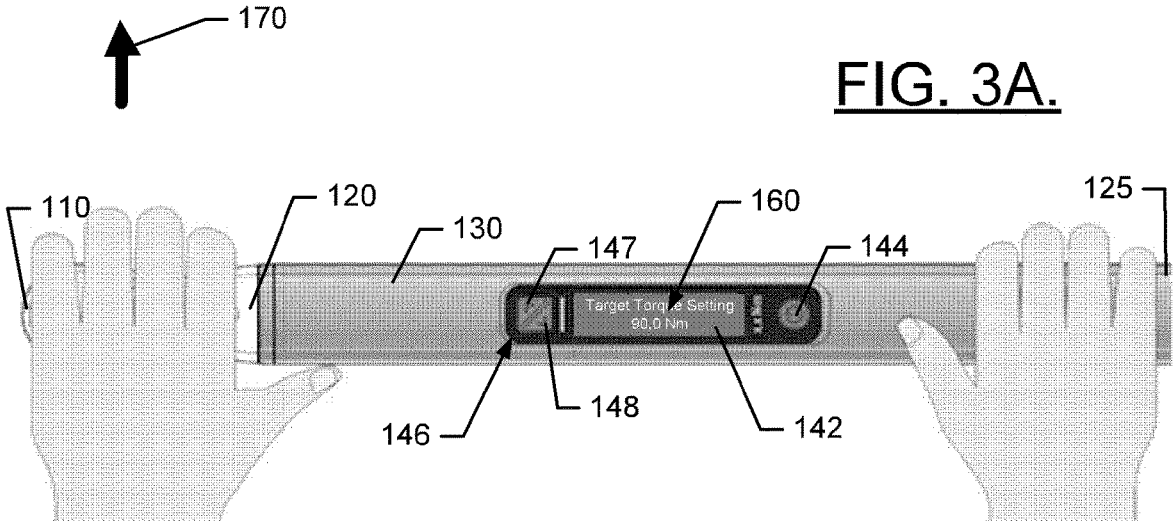
Figure 3B:
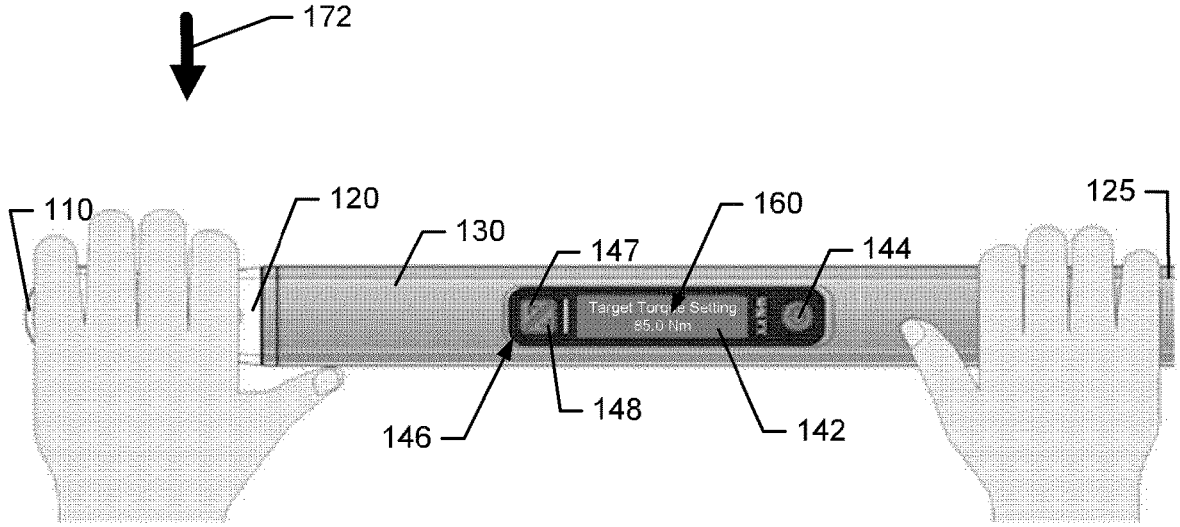
Figure 4:
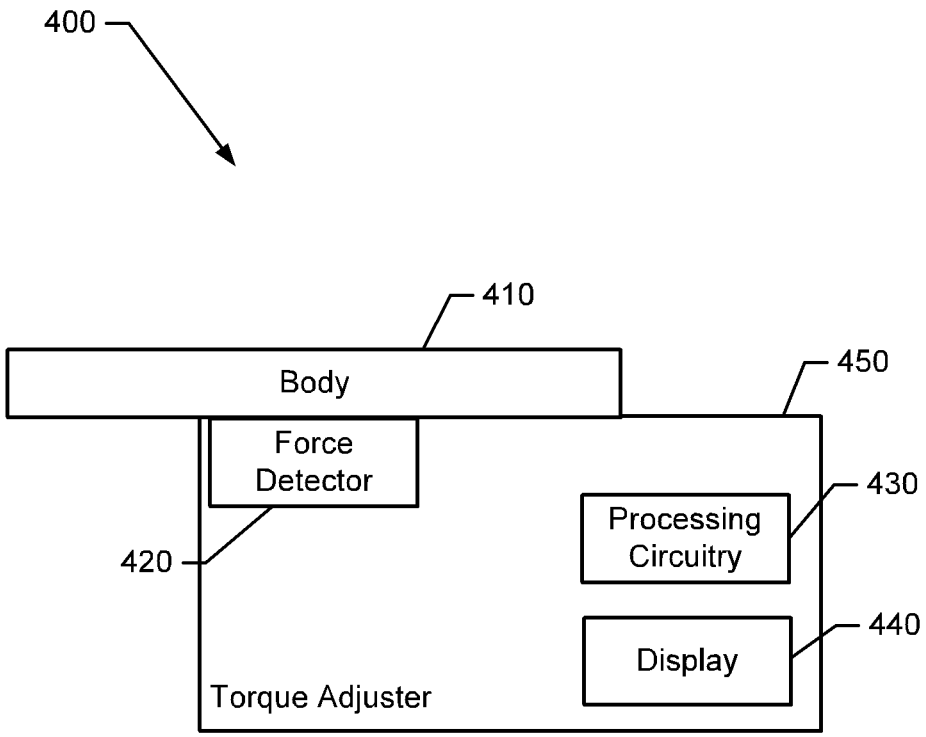

FIG. 3, which is defined by FIGS. 3A and 3B, illustrates the torque wrench of FIG. 1 being adjusted according to an example embodiment; and FIG. 4 illustrates a generic block diagram of a torque wrench according to an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to improvements to the design of a torque wrench 100. FIGS. 1-3 show various views or portions of one such example embodiment. In this regard, FIG. 1 illustrates a top view of a hand tool (e.g., the torque wrench 100) having improvements associated with an example embodiment. FIG. 2 illustrates an the same view shown in FIG. 1, except that some internal components of the torque wrench 100 are visible. FIG. 3, which is defined by FIGS. 3A and 3B, illustrates the torque wrench 100 in operation for adjustment of a torque setting. As shown in FIGS. 1, 2 and 3, the torque wrench 100 may include a head 110 (which in some cases may be a ratchet head) that may include a direction selector 112 and a driving member (not shown). The direction selector 112 may be used to select which direction torque can be applied versus which direction torque is not applied and ratcheting is enabled. However, it should be appreciated that the head 110 may have a number of different forms including open, box, ratchet, etc. The driving member may interface with a selected socket that actually interfaces with the fastener that is being torqued. Various internal components of the head 110 may control the ratcheting capability, and are outside the scope of this disclosure. However, it should also be appreciated that example embodiments could be practiced in a context in which ratcheting is either not desired or not enabled.

The torque wrench 100 may be defined by a body that includes the head 110 and a lever arm 120. The head 110 may be operably coupled to a first end (or proximal end) of the lever arm 120. A second end (or distal end) of the lever arm 120 may be opposite the first end. The head 110 may be an interchangeable head (i.e., removable from the lever arm 120 and replaceable with another head), or may be fixed to the lever arm 120 (and therefore non-interchangeable). In the fixed structure, the lever arm 120 and the head 110 (therefore the entire body) may be considered to be a single piece. In some cases, a handle assembly or handle portion 125 of the torque wrench 100 may be disposed proximate to the second end. The handle portion 125 may be part of a housing 130 of the lever arm 120. The housing 130 may be rigid, and may support gripping and the application of torque by a user. In some examples, the head 110 may have a substantially flat profile on both front and back faces thereof. Meanwhile, the lever arm 120 may maintain a width and flat profile that substantially matches that of the head 110 as the lever arm 120 extends away from the head 110 to improve accessibility of the head 110 and lever arm 120 into certain locations or proximate to potential obstructions.

The housing 130 may include a user interface 140 disposed at a portion thereof. In this regard, for example, one of the flat faces (e.g., front or back) of the housing 130 may have the user interface 140 provided thereon between the first and second ends of the lever arm 120. In some examples, the user interface may include a display 142 and one or more operable members. The operable members may include buttons, switches, or other selectors that are operably coupled to, and have functional control capability with respect to, the display 142 and the torque wrench 100 generally. In the depicted example, the operable members include a power button 144, which may be used to power the display 142 (and electronics associated therewith and/or with operation of the torque wrench 100) on and off. The operable members may also include a selector 146, which may include one or more directional buttons (e.g., up button 147 and down button 148). However, some embodiments may not include directional buttons, or the selector 146 at all.

The head 110 may be operably coupled to the lever arm 120 in such a way as to enable torque applied to the lever arm 120 to be transferred to the head 110 (and subsequently to a fastener to which the head 110 is operably coupled, e.g., via a socket) or vice versa (i.e., torque applied at the head 110 may be transferred to the lever arm 120. Moreover, when a target torque setting (which is adjustable) of the torque wrench 100 is reached, an alert (e.g., a click) may be provided to the user to indicate that the target torque setting has been reached. The internal mechanics of the torque wrench 100 for providing the alert, and for measuring the torque are outside the scope of this disclosure, and are well known to those having skill in the art. However, in some cases, a gauge 150 may be provided to detect the torque applied, and enable triggering of the alert as a consequence.

In an example embodiment, the selector 146 may be used to enter a setting mode in which the target torque setting can be adjusted. For example, the selector 146 may be depressed (or otherwise operated) to enter the setting mode. In some cases, the selector 146 may cycle through multiple other modes that are outside the scope of this disclosure prior to reaching the setting mode. When in the setting mode, a target torque setting 160 may be displayed on the display 142. While in the setting mode, the value defined by the target torque setting 160 (which is 88.5 Nm in FIGS. 1 and 2) may be adjusted. In particular, the torque wrench 100 may be configured to enable adjustment of the target torque setting 160 by applying a torque to the body of the torque wrench 100. For example, as shown in FIG. 3, a user may grasp the head 110 and handle portion 125 of the torque wrench 100 and apply a bending force to the body. The bending force applied may be detected by the gauge 150, and a corresponding adjustment may be made to the target torque setting 160.

As shown in FIG. 3A, when the bending force is applied in a first direction 170, the target torque setting 160 may be increased. In the example of FIG. 3A, the target torque setting 160 has been increased to a value of 90 Nm. In some embodiments, a rate of increase in the target torque setting 160 may be proportional to a magnitude of the bending force, as detected by the gauge 150. In other words, the target torque setting 160 may cycle through increasing values at a rate determined by the amount of the bending force applied in the first direction 170. However, it is also possible for the rate of increase in the target torque setting 160 to be constant for any bending force applied in the first direction 170 regardless of magnitude in alternative embodiments. Some example embodiments may also enable the use of the selector 146 (e.g., specifically via the up button 147) for making fine adjustments to the target torque setting 160.

Meanwhile, when the bending force is applied in a second direction 172 (i.e., opposite the first direction 170), as shown in FIG. 3B, the target torque setting 160 may be decreased. In the example of FIG. 3B, the target torque setting 160 has been decreased to a value of 85 Nm. Like operations in the increase direction, a rate of decrease in the target torque setting 160 may be proportional to a magnitude of the bending force, as detected by the gauge 150. In other words, the target torque setting 160 may cycle through decreasing values at a rate determined by the amount of the bending force applied in the second direction 172. However, it is also possible for the rate of decrease in the target torque setting 160 to be constant for any bending force applied in the second direction 172 regardless of magnitude in alternative embodiments. Some example embodiments may also enable the use of the selector 146 (e.g., specifically via the down button 148) for making fine adjustments to the target torque setting 160.

While some examples may employ bending forces to make gross adjustments, and the selector 146 to make fine adjustments to the target torque setting 160, it should be appreciated that bending forces alone may be used in some examples (in either or both of the increasing and decreasing directions). In an example embodiment, the target torque setting 160 may be increased or decreased in increments of 0.1 Nm. However, other increments that are larger or smaller are possible in alternative embodiments. Also, instead of either a constant rate of change dependent only on direction of the bending force, or a variable rate of change, which is dependent on both direction and the magnitude of the bending force, other strategies for adjustment are also possible. In this regard, for example, a time dependent strategy may be employed. The time dependent strategy may alter the rate of change based on the amount of time the bending force is applied to the torque wrench 100. For example, force application for less than a first predefined period of time (e.g., 3 seconds) may provide a first rate of increase/decrease (e.g., 0.1 Nm every 0.25 seconds). However, applying force for longer than the first predefined period of time, but less than a second predefined period of time (e.g., 3-6 seconds) may provide a second rate of increase/decrease that is larger (e.g., 1 Nm every 0.25 seconds). Applying force for an even longer time period than the second predefined period of time (e.g., a third predefined period of time) may provide a third rate of increase/decrease that is even larger (e.g., 10 Nm every 0.25 seconds).

Although FIG. 3 relates directly to changing the target torque setting 160 for the torque wrench 100, it will be appreciated that the interaction between the gauge 150 and the user interface 140 could also be used to make other adjustments for adjustable features of the torque wrench 100. Thus, example embodiments relate generally to the use of torque applied to the torque wrench 100 in order to adjust variable features of the torque wrench 100. FIG. 4 below gives a more generic description of this adjustability.

FIG. 4 is a block diagram of a torque wrench 400 according to an example embodiment. As shown in FIG. 4, a body 410 of the torque wrench 400 may be operably coupled to a force detector 420. The force detector 420 may be configured to measure strain exerted on the body 410 and convert the measured strain into an electrical signal proportional thereto in response to the application of force (e.g., a bending force or strain) to the body 410. Thus, for example, the force detector 420 may be a sensor or gauge (e.g., a strain gauge) that is operably coupled to a load cell that provides the electrical signal (e.g., as a digital output signal). The force detector 420 may in turn be operably coupled to processing circuitry 430 (e.g., including at least a processor and/or controller) that controls operation of a display 440. In some examples, the processing circuitry 430 and the display 440 may each be part of a user interface configured to enable the making of adjustments to a variable feature of the torque wrench 400. When used to adjust a target torque setting in the manner described above, the user interface and the force detector 420 may combine to form a torque adjuster 450. The torque adjuster 450 may be configured such that the target torque setting is variably adjustable via the user interface based on the bending force applied to the body 410 and detected by the force detector 420. However, other variable features that could be adjusted as an alternative to (or in addition to) adjustment of the target torque setting may include, an angle setting or any of various menu navigation options. Thus, for example, the user may navigate through any selectable options that can be provided on the user interface via the interaction between the force detector 420, the processing circuitry 430 and the display 440. When used to adjust an angle setting, the user interface and the force detector 420 may combine to form an angle adjuster. When used to navigate menu options, the user interface and the force detector 420 may combine to form a menu selector.

The force detector 420 may be configured to detect a direction and/or magnitude of the bending force applied to the body 410. In some cases, the processing circuitry 430 may further monitor the period of time the bending force is applied, or even patterns or sequences used to apply the bending force. Such information may be used to define variable options for setting of a target torque value (e.g., target torque value 160 of FIGS. 1-3) including those described above and others. As one additional example, application of a bending force within a range of 2-6 Nm (e.g., 20-50 in-lbf) may increase the target torque value at a first step size (e.g., 0.1 Nm) and a first rate depending on the time such bending force is applied. The rate may increase, as noted above, when the time spent within the range increases beyond one or more time thresholds. Application of bending force at a higher range of 6-10 Nm (e.g., 50-90 in-lbf) may increase the target torque value at a second step size (e.g., 1 Nm). Again, the rate may increase when the time spent within the higher range increases beyond one or more time thresholds. Application of a bending force at still higher levels greater than 10 Nm (e.g., 90 in-lbf) may increase the target torque value at a third step size (e.g., 10 Nm). Yet again, the rate may increase when the time spent within the higher range increases beyond one or more time thresholds. Of course, reversing the direction of the force application may cause corresponding decreases in the target torque value instead of increases.

The strategies outlined above may give the user a tremendous amount of flexibility in the speed at which adjustments can be made, and in the accuracy of making such adjustments. Moreover, the application of bending forces to make adjustments, where such adjustments depend on the direction, magnitude and/or time over which such bending forces are applied actually provide a very intuitive and comfortable way for users to make adjustments.

As can be appreciated from the example of FIGS. 1-4, example embodiments may define a hand tool (i.e., a torque wrench) with various unique features. The torque wrench may include a body, a force detector operably coupled to the body and configured to detect a bending force applied to the body, and a user interface operably coupled to the body and the force detector. The user interface may be configured to include a setting mode in which a variable feature (e.g., a target torque setting, an angle setting, or a menu navigation) of the torque wrench is adjustable. The user interface may be further configured to, when in the setting mode, adjust the variable feature based on the bending force applied to the body and detected by the force detector.

The torque wrench and/or its components may include a number of modifications, augmentations, or optional additions, some of which are described herein. These modifications, augmentations or optional additions may be included in any combination. For example, the user interface may include a display and processing circuitry. The display may be configured to display the variable feature, and the processing circuitry may be configured to increase the variable feature in response to the bending force being applied in a first direction, and decrease the variable feature in response to the bending force being applied in a second direction. In an example embodiment, the processing circuitry may be configured to adjust a rate of change of the variable feature based on a magnitude of the bending force. In some cases, the variable feature may be adjusted at a first rate when the magnitude of the bending force is in a first range, and the variable feature may be adjusted at a second rate when the magnitude of the bending force is in a second range. The first rate may be lower than the second rate, and the first range may have smaller values of the bending force than the second range. In an example embodiment, the processing circuitry may be configured to adjust a rate of change of the variable feature based on an amount of time the bending force is applied. In some cases, the variable feature may be adjusted at a first rate when the bending force is applied less than a threshold amount of time, and the variable feature may be adjusted at a second rate when the bending force is applied greater than the threshold amount of time. The first rate may be lower than the second rate. In an example embodiment, the processing circuitry may be configured to adjust a step size of changes to the variable feature based on a magnitude of the bending force. In some cases, the variable feature may be adjusted at a first step size when the magnitude of the bending force is applied less than a threshold amount of force, and the variable feature may be adjusted at a second step size when the bending force is applied greater than the threshold amount of force. The first step size may be smaller than the second step size. In an example embodiment, the processing circuitry may be configured to adjust a rate of change of the variable feature based on an amount of time the bending force is applied, and the processing circuitry may be configured to adjust a step size of changes to the variable feature based on a magnitude of the bending force. In some cases, the body may include a head including a driving member configured to be operably coupled to a socket, a lever arm operably coupled to the head at a first end thereof, and a handle portion disposed at a second end of the lever arm. The bending force may be applied by bending the head relative to the lever arm while holding the head with one hand and the handle portion with the other hand. In an example embodiment, the force detector may include a strain gauge. In some cases, the user interface may include a selector configured to enable transitioning the torque wrench to the setting mode via operation of the selector. In an example embodiment, the user interface may include an first button configured to provide increasing step adjustments to the variable feature and a second button configured to provide decreasing step adjustments to the variable feature when in the setting mode. In some cases, the first and second buttons may each have a fixed step size for adjustment of the variable feature, and the user interface may be configured to provide variable rate or step size adjustment of the variable feature based on the bending force applied.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A torque wrench comprising:

a body;

a force detector operably coupled to the body and configured to detect a bending force applied to the body; and a user interface operably coupled to the body and the force detector, wherein the user interface is configured to include a setting mode in which a variable feature of the torque wrench is adjustable, and wherein the user interface is further configured to, when in the setting mode, adjust the variable feature based on the bending force applied to the body and detected by the force detector.

2. The torque wrench of claim 1, wherein the user interface comprises a display and processing circuitry, wherein the display is configured to display the variable feature, and wherein the processing circuitry is configured to increase the variable feature in response to the bending force being applied in a first direction, and decrease the variable feature in response to the bending force being applied in a second direction.

3. The torque wrench of claim 2, wherein the processing circuitry is configured to adjust a rate of change of the variable feature based on a magnitude of the bending force.

4. The torque wrench of claim 3, wherein the variable feature is adjusted at a first rate when the magnitude of the bending force is in a first range, and the variable feature is adjusted at a second rate when the magnitude of the bending force is in a second range, and wherein the first rate is lower than the second rate, and the first range has smaller values of the bending force than the second range.

5. The torque wrench of claim 2, wherein the processing circuitry is configured to adjust a rate of change of the variable feature based on an amount of time the bending force is applied.

6. The torque wrench of claim 5, wherein the variable feature is adjusted at a first rate when the bending force is applied less than a threshold amount of time, and the variable feature is adjusted at a second rate when the bending force is applied greater than the threshold amount of time, and wherein the first rate is lower than the second rate.

7. The torque wrench of claim 2, wherein the processing circuitry is configured to adjust a step size of changes to the variable feature based on a magnitude of the bending force.

8. The torque wrench of claim 3, wherein the variable feature is adjusted at a first step size when the magnitude of the bending force is applied less than a threshold amount of force, and the variable feature is adjusted at a second step size when the bending force is applied greater than the threshold amount of force, and wherein the first step size is smaller than the second step size.

9. The torque wrench of claim 2, wherein the processing circuitry is configured to adjust a rate of change of the variable feature based on an amount of time the bending force is applied, and wherein the processing circuitry is configured to adjust a step size of changes to the variable feature based on a magnitude of the bending force.

10. The torque wrench of claim 1, wherein the body comprises:

a head including a driving member configured to be operably coupled to a socket;

a lever arm operably coupled to the head at a first end thereof; and a handle portion disposed at a second end of the lever arm, wherein the bending force is applied by bending the head relative to the lever arm while holding the head with one hand and the handle portion with the other hand.

11. The torque wrench of claim 1, wherein the force detector comprises a strain gauge.

12. The torque wrench of claim 1, wherein the user interface comprises a selector configured to enable transitioning the torque wrench to the setting mode via operation of the selector.

13. The torque wrench of claim 12, wherein the user interface comprises an first button configured to provide increasing step adjustments to the variable feature and a second button configured to provide decreasing step adjustments to the variable feature when in the setting mode.

14. The torque wrench of claim 13, wherein the first and second buttons each have a fixed step size for adjustment of the variable feature, and wherein the user interface is configured to provide variable rate or step size adjustment of the variable feature based on the bending force applied.

15. The torque wrench of claim 1, wherein the variable feature comprises a target torque setting, an angle setting or a menu navigation.

16. A torque adjuster configured to enable a torque setting of a torque wrench, the torque adjuster comprising:

a force detector operably coupled to a body of the torque wrench and configured to detect a bending force applied to the body; and a user interface operably coupled to the body and the force detector, wherein the torque setting is variably adjustable via the user interface based on the bending force applied to the body and detected by the force detector.

17. The torque adjuster of claim 16, wherein the user interface comprises a display and processing circuitry, wherein the display is configured to display the torque setting, and wherein the processing circuitry is configured to increase the torque setting in response to the bending force being applied in a first direction, and decrease the torque setting in response to the bending force being applied in a second direction.

18. The torque adjuster of claim 17, wherein the processing circuitry is configured to adjust a rate of change of the torque setting based on a magnitude of the bending force or based on an amount of time the bending force is applied.

19. The torque adjuster of claim 17, wherein the processing circuitry is configured to adjust a step size of changes to the torque setting based on a magnitude of the bending force.

20. The torque adjuster of claim 16, wherein the user interface comprises a selector configured to enable transitioning the torque wrench to a setting mode in which the torque setting is adjustable via operation of the selector, and wherein the selector defines a fixed step size for adjustment of the target torque setting.

* * * * *